United States Patent [19]

Taylor et al.

[11] 3,971,219

[45] July 27, 1976

[54] TURBINE CONTROL SYSTEM

[75] Inventors: Franklyn H. Taylor, Leominster; Edward J. Finck, Townsend, both of Mass.

[73] Assignee: General Electric Company, Schenectady, N.Y.

[22] Filed: Aug. 22, 1975

[21] Appl. No.: 606,839

[52] U.S. Cl. ..... 60/660; 60/677; 415/17

[51] Int. Cl.[2] ..... F01D 17/02; F01K 13/02

[58] Field of Search ..... 60/660, 663, 677, 678; 415/17, 30

[56] References Cited

UNITED STATES PATENTS

| | | | |
|---|---|---|---|
| 2,067,834 | 1/1937 | Ericson et al. | 415/17 |
| 2,095,860 | 10/1937 | Ericson et al. | 415/17 |
| 2,813,400 | 11/1957 | Baker | 415/17 |
| 3,091,933 | 6/1963 | Wagner et al. | 415/17 X |
| 3,446,224 | 5/1969 | Zwicky, Jr. | 415/17 |

*Primary Examiner*—Allen M. Ostrager
*Attorney, Agent, or Firm*—James W. Mitchell; John F. Ahern

[57] ABSTRACT

A control system for an extraction type steam turbine driven by steam from a steam generator wherein it is desired to control the steam pressure in the steam generator, at a predetermined level, by varying the position of the steam inlet valve. Turbine speed may be controlled at a predetermined level by varying the position of an extraction control valve. The inlet valve and the extraction valve are independently operable except under a condition where the extraction valve is completely closed and the turbine speed continues to rise. In this instance, means are provided for positioning the inlet valve according to a speed control signal which dominates an inlet pressure control signal for lowering the inlet steam valve until normal conditions are restored.

7 Claims, 1 Drawing Figure

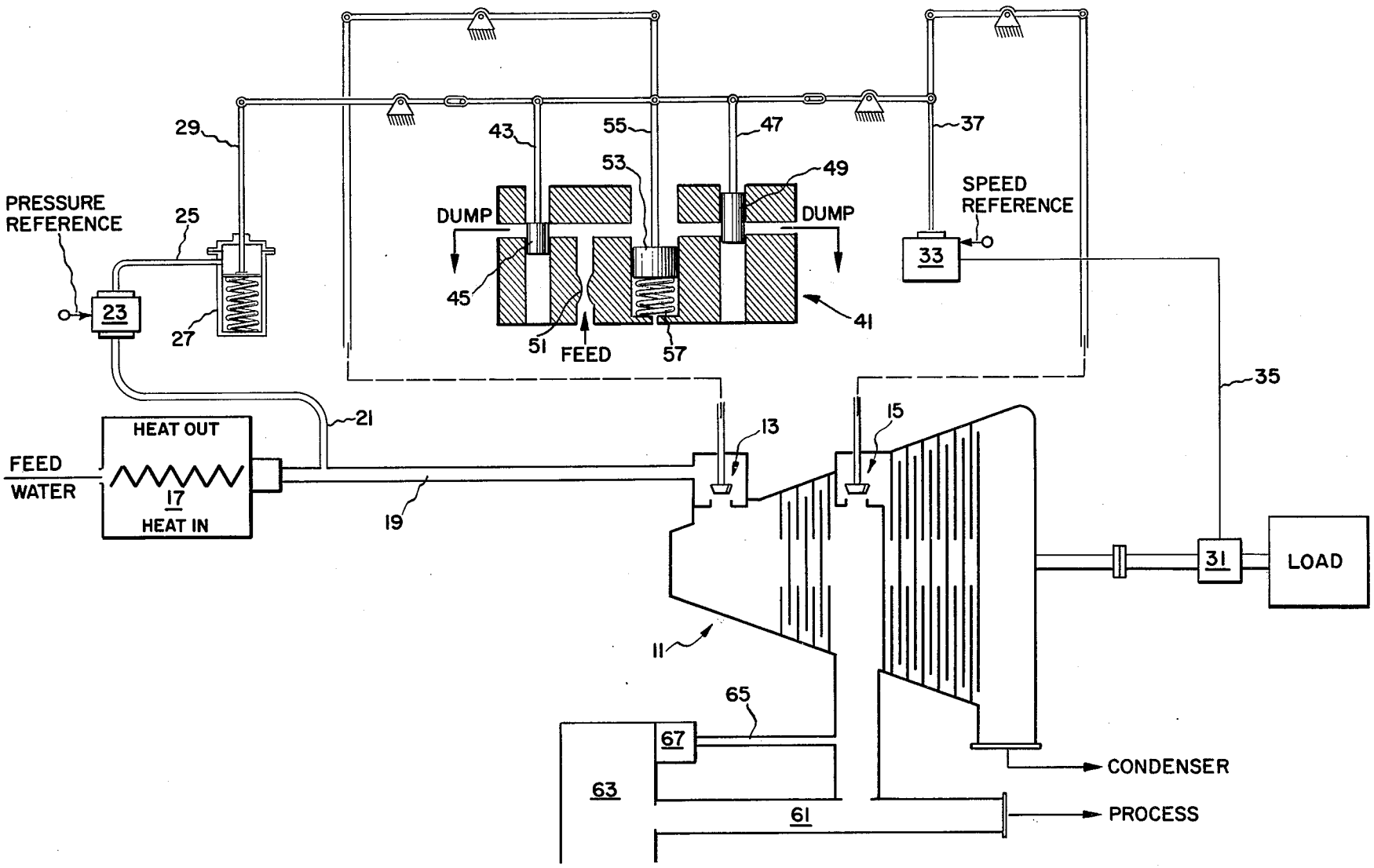
LOAD
35
31
CONDENSER
PROCESS
SPEED REFERENCE
33
37
15
41
49
DUMP
47
13
61
65
57
11
67
63
55
53
FEED
51
43
DUMP
45
19
21
29
25
27
HEAT OUT
17
HEAT IN
23
PRESSURE REFERENCE
FEED WATER

TURBINE CONTROL SYSTEM

BACKGROUND OF THE INVENTION

The present invention relates, in general, to control systems for turbomachines; and, in particular, the present invention relates to a control system for an extraction type mechanical drive steam turbine.

In a process plant, waste heat energy may be available for generating steam within a waste heat boiler (steam generator), the output, of which, may be used to drive a steam turbine. The steam output of the waste heat boiler is dependent upon the waste heat energy which is available from a process portion of the plant. It is desirable to utilize all of the waste heat energy available, and the resultant steam flow, while maintaining the boiler pressure and turbine speed at a predetermined operating level. It has been found that in an extraction type steam turbine the boiler operating condition may be maintained by varying the position of the steam inlet valve to control the steam inlet pressure. Moreover, it has been found advantageous to control turbine speed by varying the position of the extraction control valve. If the requirements of inlet pressure control and turbine speed control are satisfied, excess steam flow to the turbine may be extracted to supplement other process requirements.

It is intended, under normal operating conditions, that the inlet valve and the extraction valve be independently positionable to satisfy the foregoing requirements. However, under a condition wherein the extraction valve is completely closed and the turbine speed continues to rise, then it becomes necessary for the speed control to override the turbine inlet pressure control and thereby regulate turbine speed by using the inlet valve.

It is therefore one object of the invention to provide a control system for an extraction type steam turbine wherein turbine inlet steam pressure (flow) and turbine speed may be controlled independently of one another.

It is another object of the present invention to provide a control system for an extraction type steam turbine wherein, under certain conditions, the speed control overrides the inlet pressure control.

In order to satisfy the foregoing objects and requirements, an extraction type steam turbine is provided with a control system according to the present invention. In general, steam sufficient to satisfy turbine load and speed requirements is provided by a waste heat boiler, the output of which is input into the steam turbine through a steam inlet valve. The inlet valve is positioned according to a pressure or flow signal indirectly indicative of boiler operating condition. The turbine speed is controlled by an extraction control valve which is positioned according to a turbine speed signal. After the turbine inlet pressure requirement and turbine speed requirement have been satisfied, the excess steam may be extracted from the turbine to supplement other process plant requirements. If turbine speed can no longer be controlled by means of the extraction valve, the inlet valve position signal may be overridden by the speed control signal through an inlet valve positioning device until such time as normal speed control can be resumed.

The novel features believed characteristic of the present invention are set forth in the appended claims. The invention itself, however, together with further objects and advantages thereof, may best be understood with reference to the following description, taken in connection with the drawing.

BRIEF DESCRIPTION OF THE DRAWING

The drawing shows a schematic of an extraction turbine with related process plant conduits and a control schematic according to one preferred embodiment of the present invention.

DETAILED DESCRIPTION OF THE INVENTION

A process plant may include an extraction steam turbine 11 having an inlet valve 13 and an extraction control valve 15. Steam is generated, for driving the steam turbine, in a steam generator or waste heat boiler 17. The waste heat boiler is connected to the turbine steam inlet valve through a steam inlet conduit 19. The waste heat boiler may be a non-contact heat exchanger which passes hot waste heat process fluid in a heat-exchanger relation with a turbine feedwater supply. The boiler output steam flow may be variable and dependent upon the flow rate and temperature of the waste heat process fluid but is usually sufficient to satisfy turbine load and speed requirements under planned process conditions. An auxiliary boiler (not shown) may be included in parallel with the waste heat boiler to satisfy start-up and low heat conditions, as required. Alternatively to or in combination with the auxiliary boiler supplementary firing (not shown) may be provided for the waste heat boiler.

Waste heat boiler pressure may be indirectly controlled, in part, by the inlet valve position. That is, if the boiler pressure is too high, the inlet valve may be raised to increase the steam output from the boiler and therefore lower the boiler pressure. Conversely, if the boiler pressure is too low, the inlet valve may be lowered to decrease the steam output from the boiler and therefore raise the boiler pressure. Hence, the boiler pressure may be controlled by the positioning of the steam inlet valve. It is desirable to maintain boiler pressure at a certain predetermined level and, in accordance with the present invention, this is accomplished by positioning the inlet valve, in a manner to be described, utilizing the total heat energy available from the waste heat process fluid.

According to the present invention means are provided for sensing a steam inlet condition (pressure or flow) and for comparing said actual steam condition with a reference steam condition to provide a steam condition control signal. More specifically, the steam inlet pressure or flow is sensed within the steam inlet conduit by a pressure tap taken downsteam from the steam generator and upstream from the steam inlet valves. The pressure tap is connected to a pressure regulator or control device 23 through a conduit 21. The control device may be any known device suitable for carrying out the aforesaid sensing and comparing. For example, the device might be electrical, electronic or mechanical. In a preferred embodiment, the output of the steam pressure tap is converted into an air pressure signal (reduced proportionately) whereupon it is summed in the pressure control with a selectable pressure reference signal and compensated to provide an output error signal in the form of an air pressure signal in line 25. Line 25 is connected to an air motor 27 having an internal spring biased diaphragm connected to an output rod 29. The air motor is a transducer which converts the error signal (in terms of air pressure) to a linear displacement of rod 29 which represents the steam pressure control signal. In the event that the reference air signal, representing a preset desired steam condition level, is exceeded by the sensed steam condition, transformed into a proportionate air signal, rod 29 will lower causing the inlet steam valve to raise thereby decreasing the inlet steam pressure in a manner to be further described.

The extraction control valve may be used to control the speed of the turbine. If the extraction control valve is raised, the turbine will speed up and if the extraction valve is lowered the turbine speed will decrease assuming sufficient steam and constant load. The extraction valve may be controlled mechanically or electronically. Referring to the drawing, a speed sensing device 31 such as a tachometer-generator will convert shaft revolutions into an electrical voltage output on line 35. Line 35 is input into a control device 33. Within the control device the actual speed signal on line 35 is compared with an adjustable reference speed (voltage signal) to derive a speed error signal where the voltage difference (if a speed error is present) causes a linear translation of rod 37. If the turbine speed is too high, rod 37 will move upwardly to lower valve 15; and, if the turbine speed is too low, rod 37 will move downwardly to raise valve 15. The control device 33 is commercially available and is of the type comprising electrically operated pilot valves which control the flow of hydraulic fluid which pressurizes a piston (not shown) at the lower portion of rod 37.

The mechanical output of rod 29 is a steam condition signal which provides a first input into an inlet valve positioning means 41. The output of rod 29 either raises or lowers a rod 43 connected to a first pilot valve 45. The mechanical output of rod 37, while directly actuating extraction control valve 15 for speed control, also positions rod 47 and a second pilot valve 49 to provide a second input into the inlet valve positioning means. The inlet valve positioning means is a hydraulic actuator having a pressurized fluid input (feed) through orifice 51, and a pair of dump lines, one for each pilot valve. According to the positioning of the first and second pilot valves by the first and second inputs, respectively, a piston 53 will provide an output to rod 55 which, in turn, positions the steam inlet valve. Piston 53 is biased in a valve close position by spring 57. The pilot valves 45 and 49 are so positioned so that under normal operating conditions, the first pilot valve having a first input corresponding to a steam inlet condition controls the steam inlet valve while the second pilot valve does not affect inlet valve operation. Under a condition where the extraction control valve 15 is completely closed and rod 37 continues to rise (due to increasing turbine speed), the pilot valve 49 will move downwardly to call for a lower inlet valve position to decrease the flow of steam through the turbine and hence will override the inlet steam condition control. In this respect, the hydraulic actuator 41 acts as a low value gate.

The steam extracted from the turbine through an extraction conduit 61 is a function of the amount of inlet steam remaining after the turbine speed-load requirements have been satisfied. The extraction steam may then be used to supplement a controlled flow of process steam from a process boiler 63. In order to more efficiently control process boiler 63, an extraction pressure feedback line 65 may be input into a boiler control 67 in a manner known to one of ordinary skill in the art.

One manner of operating a process plant according to the present invention may be described as follows. Assuming that there is waste heat available to boiler 17, the inlet steam condition sensing means picks up an inlet condition in conduit 19 and compares it to a reference signal. If the steam condition is too low, the output on rod 29 will be insufficient to cause rod 43 to raise thereby allowing hydraulic fluid to dump as valve 13 remains closed. When the steam condition reaches the reference set point, rod 29 will lower to set pilot valve 45 in equilibrium so that amount of hydraulic fluid input into hydraulic actuator 41 will equal the fluid output at the first pilot valve dump. This causes steam inlet valve 13 to be raised to maintain the equilibrium condition. If the steam condition exceeds the reference set point, rod 29 will lower further to discontinue the fluid dump thereby causing piston 53 to lower against valve closing spring 57 whereupon steam inlet valve 13 is raised until equilibrium is reached. If thereafter, the sensed condition falls below the reference set point, then fluid will again be dumped through pilot valve 45 causing the valve to lower. In this manner, boiler pressure is indirectly maintained at a desired level.

Speed is controlled in a similar manner according to the output of rod 37 which positions the extraction control valve 15 through the linkage shown rather than through the hydraulic actuator 41.

In the event that the extraction control valve 15 is completely closed in response to a speed control signal on rod 37 and turbine speed continues to rise, then speed control is attained through the hydraulic actuator and steam inlet valve. At this point, the pilot valve 49 is positioned by rod 47 so that it will cause fluid to dump thereby lowering valve 13 and overriding the position dictated by the first pilot valve 45 until normal speed conditions are restored.

While there is shown what is considered, at present, to be the preferred embodiment of the invention, it is, of course, understood that various other modifications may be made therein. For example, mechanical sensors, transducers and control devices may be replaced by electrical or electronic equivalents and vice-versa. It is intended to claim all such modifications as fall within the true spirit and scope of this invention.

What is claimed is:

1. A control system for an extraction steam turbine of the type having a steam inlet valve and an extraction control valve, said steam turbine being driven by steam from a steam generator in fluid communication with said steam inlet valve through a steam inlet conduit, said control system comprising:

means for sensing a steam inlet condition and for comparing said steam inlet condition with a reference steam condition to derive a steam condition control signal;

means for sensing turbine speed and for comparing said turbine speed with a reference speed to derive a speed control signal;

means for positioning said extraction control valve in response to said speed control signal; and, means for positioning said steam inlet valve, said inlet valve positioning means having a first input proportional to said steam condition control signal and a second input proportional to said speed control signal; and, said inlet valve positioning means having a single output for positioning said steam inlet valve, said output being in accordance with said steam condition control signal unless it is overridden by said speed control signal calling for a lower inlet steam valve position.

2. The control system recited in claim 1 wherein said steam inlet condition is steam pressure upstream from said steam inlet valve.

3. The control system recited in claim 1 wherein said steam inlet condition is steam flow upstream from said steam inlet valve.

4. The control system recited in claim 1 wherein said steam inlet valve positioning means comprises:

a pressurized fluid manifold having first and second independently positionable input pilot valves and a fluid controlled output piston; said first input pilot valve positioned by said steam condition control signal, said second input pilot valve positioned by said speed control signal; said second pilot valve being operative to dump pressurized fluid only when said extraction control valve is closed and turbine speed continues to rise.

5. The control system recited in claim 4 wherein the output piston is operatively connected to the steam inlet valve.

6. The control system recited in claim 1 wherein the extraction steam turbine includes an extraction conduit downstream from said steam inlet valve and upstream from said extraction control valve.

7. A control system for a steam turbine having a steam inlet valve and an extraction control valve, said turbine further including an extraction conduit downstream from the steam inlet valve and upstream from the extraction control valve; and, said steam turbine being driven by steam from a steam generator in fluid communication with said steam inlet valve through a steam inlet conduit, said control system comprising:

means for providing a first signal proportional to the difference between a reference steam inlet pressure and the actual steam inlet pressure;

means for providing a second signal proportional to the difference between a reference turbine speed and the actual turbine speed;

means for positioning said extraction control valve in response to said second signal;

means for positioning said steam inlet valve, said inlet valve positioning means including a gating device having first and second inputs corresponding to said first and second signals, respectively, the output of said gating device following whichever input calls for the lowest steam inlet valve position.

* * * * *